US010525742B2

(12) United States Patent
Fernandez et al.

(10) Patent No.: US 10,525,742 B2
(45) Date of Patent: Jan. 7, 2020

(54) DUPLEX PRINTING

(71) Applicant: Hewlett-Packard Development Company, L.P., Houston, TX (US)

(72) Inventors: Cesar Fernandez, San Diego, CA (US); Jose Galmes, San Diego, CA (US); Alisher Alikhodjaev, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/174,038

(22) Filed: Oct. 29, 2018

(65) Prior Publication Data

US 2019/0061383 A1 Feb. 28, 2019

Related U.S. Application Data

(63) Continuation of application No. 15/519,799, filed as application No. PCT/US2014/064711 on Nov. 9, 2014, now Pat. No. 10,201,990.

(51) Int. Cl.
*B41J 11/46* (2006.01)
*B41J 3/60* (2006.01)

(52) U.S. Cl.
CPC ..... *B41J 11/46* (2013.01); *B41J 3/60* (2013.01)

(58) Field of Classification Search
CPC ..... B41J 11/41; B41J 11/46; B41J 3/60
USPC ..... 347/16
See application file for complete search history.

(56) References Cited

U.S. PATENT DOCUMENTS

| | | | | |
|---|---|---|---|---|
| 8,169,657 | B2 | 5/2012 | Wang et al. | |
| 8,254,825 | B2 | 8/2012 | Tooker et al. | |
| 8,303,071 | B2 | 11/2012 | Eun | |
| 8,733,884 | B2 | 5/2014 | Rzadca et al. | |
| 2002/0081132 | A1 | 6/2002 | Miyamoto et al. | |
| 2005/0174379 | A1* | 8/2005 | Nakazawa | B41J 3/60 347/19 |
| 2009/0016785 | A1 | 1/2009 | Haan et al. | |
| 2010/0013882 | A1 | 1/2010 | Miszes et al. | |

(Continued)

FOREIGN PATENT DOCUMENTS

| | | |
|---|---|---|
| CN | 1208217 A | 2/1999 |
| CN | 103221217 A | 7/2013 |

(Continued)

OTHER PUBLICATIONS

International Search Report & Written Opinion dated Aug. 7, 2015, received in PCT Application No. PCT/US2014/064711, filed Nov. 9, 2014, Korean Intellectual Property Office, 11 pages.

(Continued)

*Primary Examiner* — Stephen D Meier
*Assistant Examiner* — Alexander D Shenderov
(74) *Attorney, Agent, or Firm* — HP Inc. Patent Department

(57) ABSTRACT

In one example a method is disclosed for printing duplex images. The method includes printing an image on side A of media, including an alignment mark. Detecting the alignment mark with a sensor. The velocity of the media is determined when the alignment mark is detected. Printing an image on side B of the media where the location of the image on side B is dependent on the velocity of the media. In another example a printer is disclosed that uses the method to print duplex images.

17 Claims, 6 Drawing Sheets

(56) References Cited

U.S. PATENT DOCUMENTS

| | | | | |
|---|---|---|---|---|
| 2010/0123752 | A1 | 5/2010 | Eun et al. | |
| 2011/0019876 | A1 | 1/2011 | Galoppo et al. | |
| 2012/0242730 | A1 | 9/2012 | Leighton et al. | |
| 2013/0101331 | A1* | 4/2013 | Morrow | B41J 3/60 400/621 |
| 2013/0286072 | A1 | 10/2013 | Armbruster et al. | |
| 2014/0015909 | A1* | 1/2014 | Leighton | B65H 23/32 347/104 |

FOREIGN PATENT DOCUMENTS

| | | | |
|---|---|---|---|
| WO | WO-2007/092490 | A2 | 8/2007 |
| WO | WO-2008/080883 | A1 | 7/2008 |

OTHER PUBLICATIONS

Ricoh Americas Corp., "Ricoh Introduces New Monochrome Production Printing Powerhouse", Sep. 10, 2013, 2 pages, Retrived from the Internet on Jul. 26, 2017 <https://www.ricoh-ap.com/node/16093>.

* cited by examiner

DUPLEX PRINTING

PRIORITY

This application is a Continuation of commonly assigned and co-pending U.S. patent application Ser. No. 15/519,799, filed Apr. 17, 2017, which is a national stage filing under 35 U.S.C. § 371 of PCT Application Number PCT/US2014/064711, having an international filing date of Nov. 9, 2014, the disclosures of which are hereby incorporated by reference in their entireties.

BACKGROUND

Inkjet printers are printers that eject printing fluids onto media from a plurality of nozzles of one or more printheads. The printheads can be thermal inkjet printhead, piezo electric printhead or the like. Printing fluid is any fluid deposited onto media to create an image, for example a pre-conditioner, gloss, a curing agent, colored inks, grey ink, black ink, metallic ink, optimizers and the like. Inkjet inks can be water based inks, solvent based inks or the like. LaserJet printers are printers that deposit toner onto media. Once the toner is deposited onto the media the toner is heated to fuse the toner to the media.

Both types of printers may print on a single side of a page (simplex printing) or on both sides of the page (duplex printing). On a duplex page the images are typically aligned between the two sides of the page. When the image on the first side of the page is miss-aligned with the image on the second side of the page, the image or text will appear to jump up and down or side to side when the pages in a document are flipped back and forth. In addition, if the printer uses a roll of media, miss-alignment between the two sides may cause waste when the roll is cut into sheets.

DETAILED DESCRIPTION

Figure 1:
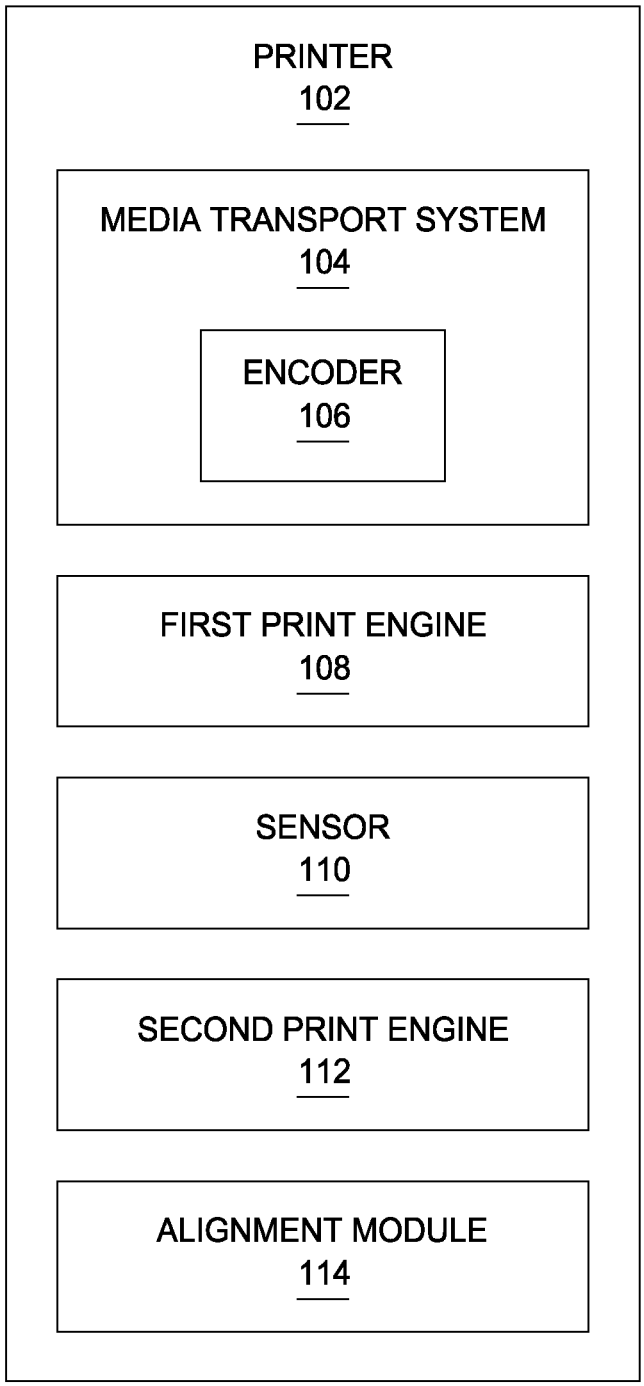
FIG. 1 is a block diagram of an example printer 102.

Many printers can print on a single side of a page (simplex printing) or on both sides of the page (duplex printing). Some printers only have one print engine and move the media past the print engine twice while duplex printing. During the first pass an image is deposited onto the first side of the media. During the second pass an image is deposited onto the second side of the media. Other printers have two print engines and use the first print engine to deposit images on the first side of the media and the second print engine to deposit images on the second side of the media.

A print engine is defined as any device that can deposit marking material onto media, for example an inkjet print engine, a LaserJet print engine or the like. Marking material is any substance that can create an image on media, for example printing fluid or toner. Printing fluid is any fluid deposited onto media to create an image, for example a pre-conditioner, gloss, a curing agent, colored inks, grey ink, black ink, metallic ink, optimizers and the like.

Printers may use sheets of media or may use rolls of media. Printers that use rolls of media typically have two print engines for duplex printing. The first print engine is used to print on the first side of the media. The second print engine is downstream from the first print engine and is used when printing on the second side of the media (i.e. duplex printing). Downstream is defined as the direction the media travels during printing.

One way current printers align the images on the two sides of the media is using an alignment mark, typically a top of form (TOF) mark. The TOF mark is printed at the beginning of each frame or page on the first side of the media using the first print engine. A sensor between the first print engine and the second print engine detects the TOF mark on the first side of the media. The sensor is located a predetermined distance from the second print engine. The sensor determines the position of the mark on the media. The paper transport system keeps track of the distance the media travels in the paper path of the printer. Using the distance the media travels and the position of the mark on the media, the second print engine can be set to start printing the duplex image when the first image should be located above the second print engine.

Unfortunately manufacturing tolerances for the sensor and print engine locations, as well as delays in the electronics, introduce errors in the system. These types of errors can be corrected by using a calibration process for each printer. During the calibration process, a special pattern is printed on both sides of the media at a given printing speed (i.e. the calibration speed). An automated vision system or an operator measures the miss-alignment between the two patterns. The miss-alignment between the two patterns is equal to an alignment offset. This alignment offset is entered into the printer and the printer uses it to move the image printed by the second print engine into alignment with the image printed on the first side of the media.

Unfortunately the offset only works for the speed the printer was using during the calibration process. When the printer changes speed, a new calibration may be needed. In some cases a printer will run the calibration procedure at a number of different printing speeds and save the results. The printer will use the saved alignment offset closest to the current printing speed when printing duplex pages. When the printer is using an alignment offset from a speed that does not match the current printing speed, there will be some miss-alignment between the images on the first side of the media and images on the second side of the media.

Calibrating the printer at a number of different speeds takes time and uses media. The calibration alignment offsets are also only completely accurate at the speed the printer was operating at during the calibration process (i.e. the calibration speed). The calibration offsets are also not helpful when the printer speed is "on-the-ramp". When a printer is accelerating up to a printing speed or decelerating down from a printing speed the printer's speed is known as "on-the-ramp".

Printers take time to reach a given printing speed. Currently printers do not print while the speed is on-the-ramp, they wait until the printer has reached the correct speed before beginning to print duplex pages. A printer can waste between 10 and 100 meters of media when accelerating up to a printing speed or decelerating down from a printing speed. For example, the amount of paper saved if the printer starts printing on the ramp at 200 feet per minute (fpm)

instead of waiting until the printer reaches a final printing speed of 800 fpm is 50 meters, assuming an acceleration of 6 inches/per second squared.

In one example, a printer will position the location of the duplex image on the second side of the media using the instantaneous velocity of the paper when the TOF mark is detected. By using the speed of the media at a given instance in time, the duplex image can be aligned with the image on the first side of the media at any given printing speed, including "on-the-ramp" speeds.

FIG. 1 is a block diagram of an example printer 102. Printer 102 comprises a media transport system (MTS) 104, a first print engine 108, a second print engine 112, a sensor 110 and an alignment module 114. The MTS is defined as the mechanism that moves media through the printer. The MTS includes encoder 106. The MTS may also include: input trays, output trays, input spindles, output spindles, one or more sets of pinch rollers, one or more sets of take-up rollers, motors, gears and the like, but these items are not shown for clarity.

Encoder 106 is used to determine the position and velocity of media in the MTS. In some examples encoder may be a rotary encoder coupled to a pinch roller or the like. As the media moves between the set of pinch rollers, the encoder rotates and the amount of rotation is proportional to the distance the media moved in the media path. The rate of rotation is proportional to the velocity of the media through the media path. A media path is the path the media takes as it moves through the printer.

The first and second print engines may be any type of print engine, for example a LaserJet print engine, an inkjet print engine or the like. The first print engine is located at a first position in the media path in the MTS. The first print engine is positioned to print onto the first side of the media (typically called side A). The second print engine is positioned in the media path downstream from the first print engine. The direction the media travels during printing is defined as the downstream direction. The second print engine is positioned to print onto the second side of the media (the duplex side, typically called side B).

The sensor 110 is located in the media path between the first and second print engines. The sensor is positioned to view the first side of the media (side A). The sensor is used to detect an alignment mark printed by the first print engine. Typically the alignment mark is a Top-of-Form (TOF) mark printed at the start of a frame or page.

The alignment module is coupled to the encoder 106, the first and second print engines and sensor 110. In some examples, alignment module may be implemented in hardware, software including firmware, or combinations thereof. For example the firmware may be stored in memory and executed by a suitable instruction execution system. If implemented in hardware, as an alternate example, the alignment module may be implemented with any combination of technologies, for example discrete-logic circuits, application specific integrated circuits (ASIC), programmable gate arrays (PGAs), field programmable gate arrays (FPGAs) or the like. In some examples the alignment module 114 may be implemented in a combination of software and data, executed and stored under the control of a computing device.

Figure 2:
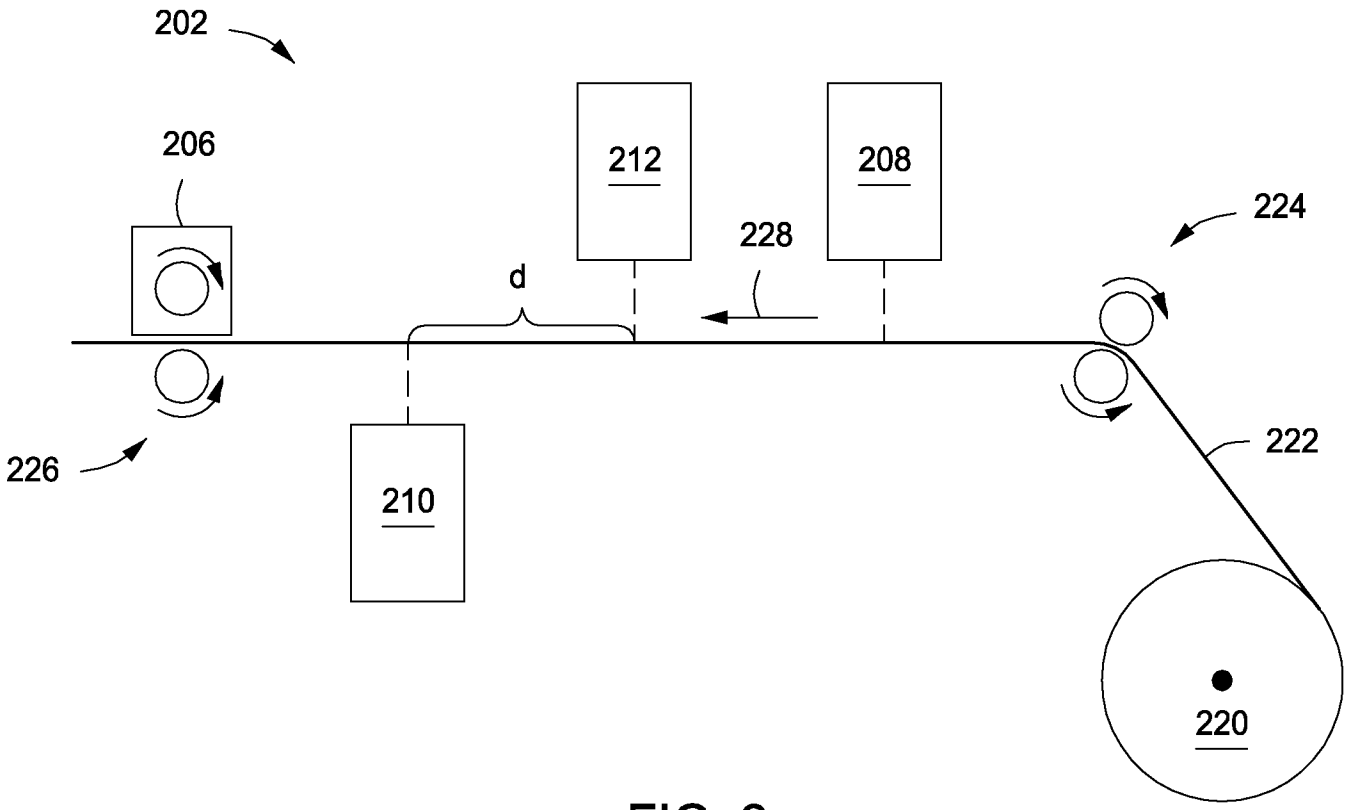
FIG. 2 is a schematic view of an example printer 202.

FIG. 2 is a schematic view of an example printer. For example the printer of FIG. 1. Printer 202 comprises an input unwinder 220, a pair of pinch rollers 224, a first print engine 208, a sensor 212, a second print engine 210, a pair of take-up rollers 226 and an encoder 206. In this example the media transport system (MTS) uses a continuous roll of media 222 mounted onto input spindle 220. In other examples the printer may use sheets of media instead of a continuous roll of media 222. A media path starts at the input spindle 220, goes between the pair of pinch rollers 224, underneath the first print engine 208 and the sensor 212, above the second print engine 210, and then between the pair of take-up rollers.

The encoder 206 is coupled to the pair of take-up rollers 226 and its rotation is proportional to the distance the media travels between the pair of take-up rollers 226. The rate of rotation of the encoder is proportional to the velocity of the media in the media path. The media moves in the direction of arrow 228 during printing. The direction the media moves during printing is also known as the downstream direction. Therefore the sensor 212 and the second print engine are downstream from the first print engine 208. The second print engine 210 is downstream from the sensor by distance d. The distance d is equivalent to a given number of encoder counts in encoder 206.

A printer can be calibrated at a single printing speed to align the duplex image with the simplex image using only the location of the alignment mark by measuring the alignment offset between two patterns printed by the two print engines. The alignment offset between the two patterns is caused by two different types of errors: errors due to a delay in time and errors due to a delay in space. The time delays have an effect on where the drops land on the paper depending on the media speed, while the space delays have a constant offset on drop placement on media, regardless of the media speed.

Errors that add a delay in space cause miss-alignments that are independent of the speed of the media. One example is the variation in the location of the sensor 212 with respect to the location of the second print engine 210 (i.e. distance d) due to manufacturing tolerances. Different distances d cause a different number of encoder counts between the time the alignment mark is detected and when the simplex image reaches the duplex print engine. Another example of an error in space delay is related to when the printheads fire the drops from a particular column of nozzles. The printheads fire the drops for one particular column when the data for the next column is received which is at the next encoder count. That introduces a delay equal to 1 encoder count or 1 column distance on paper (1/600 inches when printing at 600 dpi), regardless of the media speed.

Errors that add delays in time cause miss-alignments that are dependent on the media speed/velocity. One example of a time delay is the response time of the sensor. In one example, the response delay of the TOF sensor is 50 μs, regardless of the media speed. It takes 50 μs for the sensor to toggle its output after it has detected the TOF mark. Although that delay is constant and independent of the media speed, during those 50 μs, the paper advances more or less depending on its speed. Another example of a time delay is the drop fly time. The drop fly time is the time it takes for the ink drops to land on the paper once they are ejected.

The total alignment offset detected by the vision system during a calibration is equivalent to the amount of media that goes by the duplex print engine during the time between when the sensor detects the alignment mark till when the simplex image reaches the duplex print engine. The alignment offset is a combination of both the time delays and the space delays. This alignment offset can be expressed by the following formula using the two error types:

$$O_{cal}=v_{cal}\times T_e+d_e \qquad \text{Equation 1}$$

Where:

$O_{cal}$ is the alignment offset detected by the vision system (or measured by the operator)

$v_{cal}$ is the media speed/print speed during the calibration process $T_e$ is the accumulated time delay error.

$d_e$ is the accumulated distance error for all the encoder or space delay sources (independent of the paper speed)

The time delay error may comprise the following error sources:

TOF sensor output delay: for example 50 μs

The chain of electronic boards, cables and fiber optics sending the TOF signal from the sensor to the image processing electronics: for example between 10 and 200 μs.

The print data travelling from the image processing electronics to the printbars: for example 0.5 μs for a 100 m long FO trunk.

The printbar electronics: for example a few microseconds

Drop fly time: for example 75 μs

As explained before, these time delays are independent of the media speed but their effect on registration does depend on the media speed.

The space delay error may comprise the following error sources:

The TOF sensor light spot has to be fully inside the mark to detected it: approx. 0.5 mm The image processing electronics: a couple of encoder counts Print head: 1 encoder count The distance d between the sensor and the print engine including any mechanical errors mounting the TOF sensor and the print engine in encoder counts.

In one example, the printer will position the location of the duplex image on the second side of the media using the instantaneous velocity of the media when the alignment mark is detected. By using the velocity of the media at a given instance in time, the duplex image can be aligned with the image on the first side of the media at any given printing speed, including "on-the-ramp" speeds. The alignment module will latch the encoder position as well as the instantaneous velocity of the media when the sensor detects the alignment mark. Using equation 1 the alignment offset $O_{cal}$ can be determined for any given speed, including "on-the-ramp" speeds.

Figure 3:
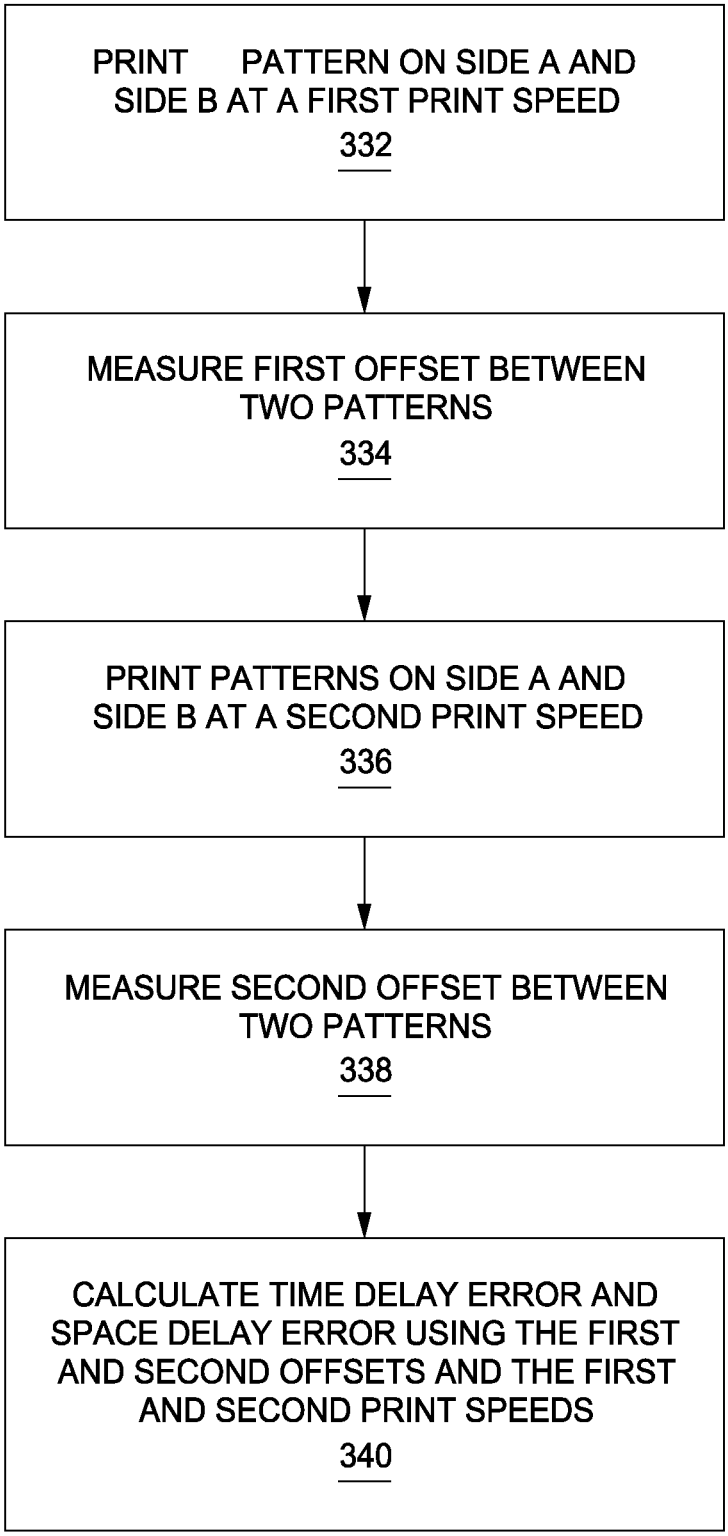
FIG. 3 is a flow chart for an example alignment calibration process.

The two constants in equation 1, $T_e$ and $d_e$, may be different for each printer and can be determined during an alignment calibration process. FIG. 3 is a flow chart for an example alignment calibration process. At block 332 an alignment pattern will be printed on both sides of the media at a first printing/media speed. At block 334 a first offset between the first and second images will be measured. The offset can be measured using an automated vision system or a human operator. At block 336 a second set of alignment patterns will be printed on side A and side B of the media at a second printing/media speed. At block 338 a second offset between the first and second images will be measured. At block 340 the time delay error $T_e$ and the space delay error $d_e$ will be calculated using the first and second offsets and the first and second print speeds. The time delay error $T_e$ and the space delay error $d_e$ can be calculated as follows:

$$T_e = \frac{O_{fast} - O_{slow}}{v_{fast} - v_{slow}}$$

$$d_e = O_{fast} - v_{fast} \times T_e$$

In one example the first printing/media speed will be a fast printing/media speed ($V_{fast}$) and the second printing/media speed will be slow ($V_{slow}$). In one example the fast printing speed may be the maximum printing speed for the printer and the slow printing speed may be the minimum printing speed for the printer. In some examples the maximum print speed may be between 700 and 1,000 feet per minute (fpm), for example 800 fpm. In some examples the minimum print speed may be between 50 and 350 fpm, for example 200 fpm. In some examples the printer will print at the two different print speeds during the alignment calibration process without bring the printer to a full stop between the two speeds.

Figure 4:
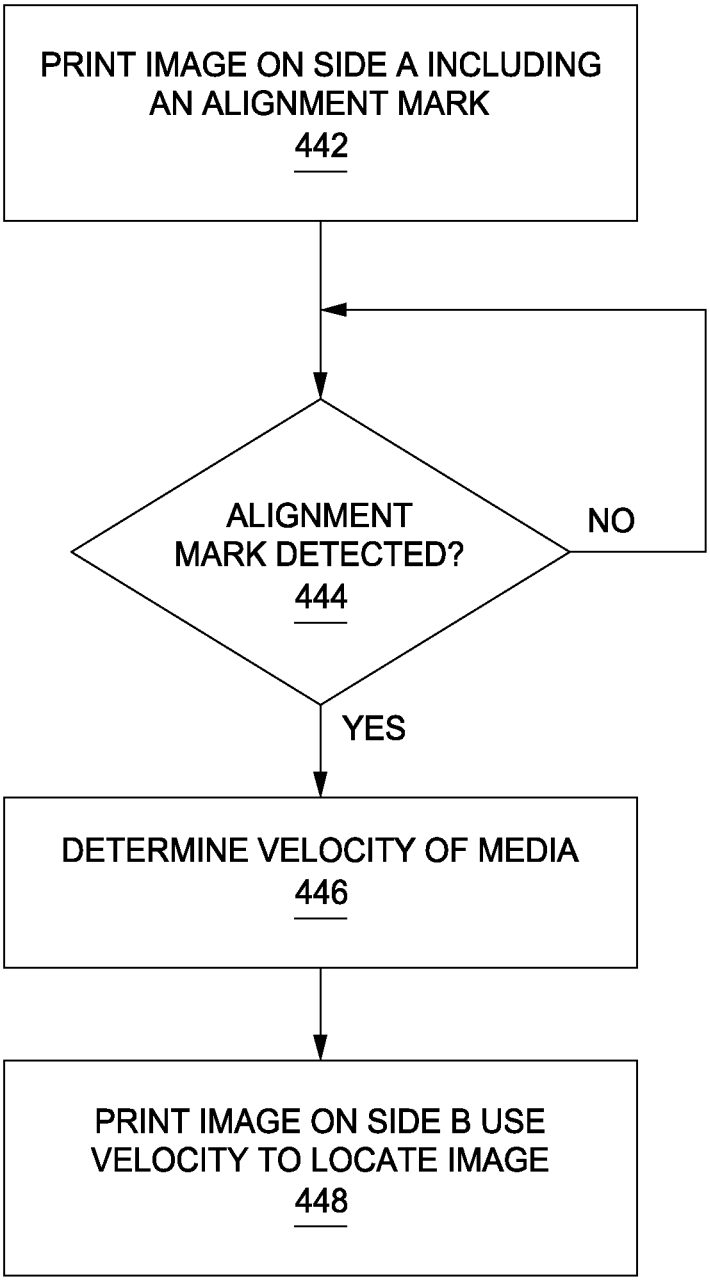
FIG. 4 is a flow chart for printing duplex pages in one example.

Equation 1 can be used at any print speed to determine the correct alignment offset to use to align the duplex image to the simplex image. FIG. 4 is a flow chart for printing a duplex image in one example. At block 442 an image, including an alignment mark, is printed on side A of the media. At block 444 a check is made to determine if the alignment mark has been detected by the sensor. If the alignment mark has not been detected, flow returns to block 444. When the alignment mark is detected flow continues at block 446. At block 446 the position of the alignment mark and velocity of the media is determined and latched/stored. At block 448 the image is printed onto side B of the media where the location of the image is based on the velocity of the media. In this example, equation 1 is used to determine the correct alignment offset for each frame/page when the velocity of the media is constant and when the velocity of the media is changing.

Figure 5:
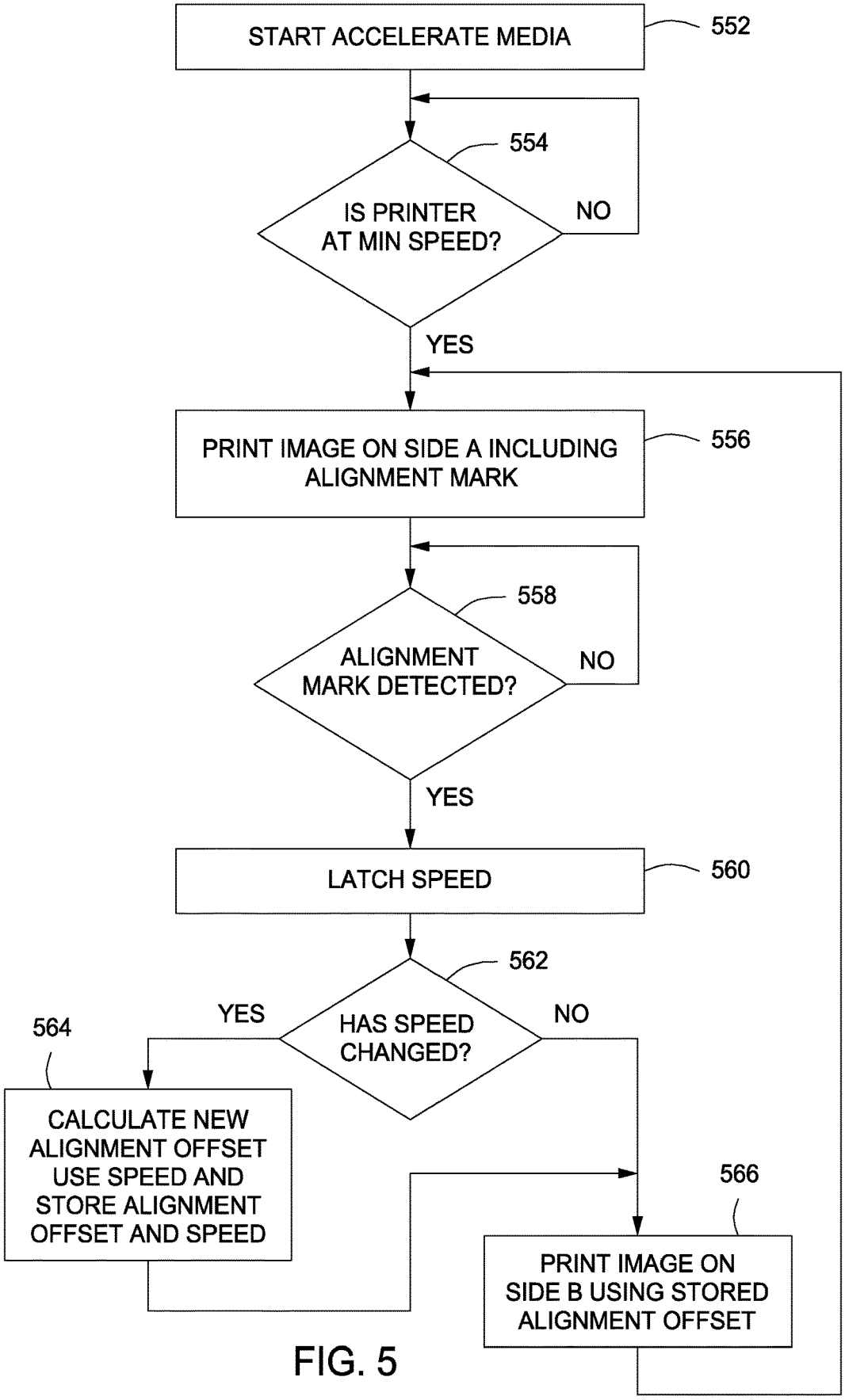
FIG. 5 is a flow chart for printing duplex pages in another example.

In another example, when the print/media speed is a constant, equation 1 will be used one time to determine the correct alignment offset when printing the first frame. The determined alignment offset will then be re-used for each frame as long as the printing/media speed remains constant. When printing "on-the-ramp" a new alignment offset is calculated for each frame/page being printed. Once the target printing speed is reached the same alignment offset can be re-used. FIG. 5 is a flow chart for printing duplex pages in another example. At block 552 the printer starts accelerating the media. At block 554 a check is made to determine if the media has reached the minimum printing speed. In some examples the printer may be able to print at any speed above zero. In other example the printer may only be able to print once the media has reached a minimum speed, for example 200 fpm.

If the media has not reached the minimum printing speed, flow loops back to block 554. When the media has reached the minimum printing speed flow continues in block 556. At block 556 an image, including an alignment mark, is printed on side A of the media. At block 558 a check is made to see if the alignment mark has been detected by the sensor. If the alignment mark has not been detected, flow returns to block 558. When the alignment mark has been detected, flow continues in block 560.

At block 560 the position of the alignment mark and the media velocity are determined. At block 562 a check is made to determine if the current media velocity has changed from the last time it was saved. When the media velocity has changed flow continues at block 564. A change in media velocity can be a change of velocity above some threshold velocity. In some examples the velocity threshold may be in the range between 0.1 feet per second (fps) and 10 fps, for example 1 fps. In other examples the velocity threshold may be lower or higher. At block 564 a new alignment offset is calculated, for example using equation 1, using the current media velocity. The new alignment offset and current media velocity/speed are stored. Flow then continues at block 566. When the media velocity has not changed in block 562 flow continues at block 566. At block 566 an image is printed onto side B of the media using the stored alignment offset.

Figure 6:
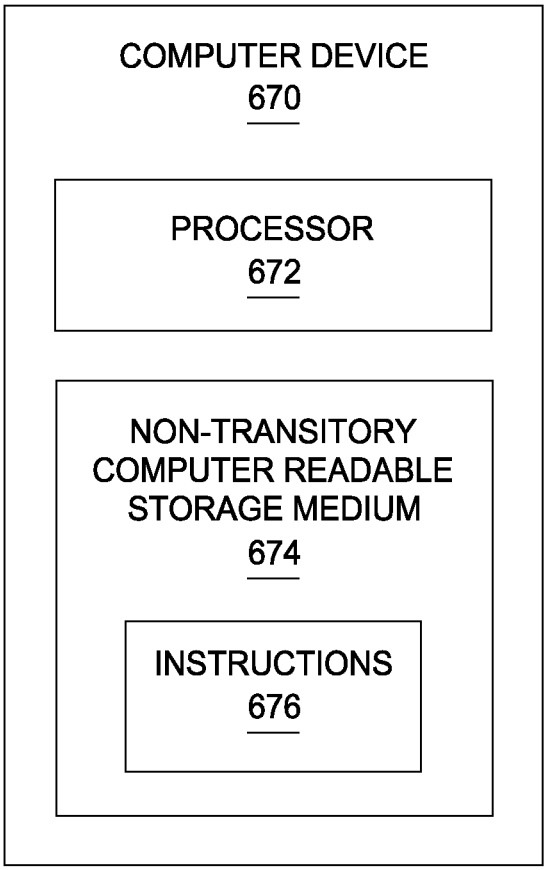
FIG. 6 is a block diagram illustrating an example computing device.

FIG. 6 is a block diagram illustrating a computing device including a processor and a non-transitory, computer readable storage medium to store instructions to print duplex images according to an example. The non-transitory, computer readable storage medium 674 may be included in a computing device 670 such as a printer to print duplex images, for example the printer shown in FIG. 1. The non-transitory, computer readable storage medium 674 may comprise volatile memory, non-volatile memory, and a storage device. In one example the storage medium may be memory in the alignment module shown in FIG. 1. Examples of non-volatile storage medium include, but are not limited to, electrically erasable programmable read only memory (EEPROM) and read only memory (ROM). Examples of volatile memory include, but are not limited to, static random access memory (SRAM), and dynamic random access memory (DRAM). Examples of storage devices include, but are not limited to, hard disk drives, compact disc drives, digital versatile disc drives, optical drives, and flash memory devices.

What is claimed is:

1. A printer, comprising:

a media transport system (MTS) for moving media through the printer, the media transport system including an encoder and a media path;

a first print engine for printing on a first side of the media, the first print engine positioned at a first location in the media path;

a second print engine for printing on a second side of the media, the second print engine positioned in the media path downstream from the first location;

a sensor positioned between the first and the second print engines and positioned to view the first side of the media;

an alignment module coupled to the sensor, the encoder and the first and the second print engines;

the alignment module to detect an alignment mark on the first side of the media using the sensor and to determine a velocity of the media with the encoder when the alignment mark is detected;

the alignment module to calculate an alignment offset based on the velocity of the media and to print duplex images onto the media with the second print engine where the location of the duplex images are using the alignment offset.

2. The printer of claim 1, wherein the alignment module only recalculates the alignment offset when the media velocity has changed by more than a threshold velocity.

3. The printer of claim 1, wherein the alignment offset is calculated using a time delay error $T_e$ and a space delay error $d_e$.

4. The printer of claim 3 wherein the time delay error $T_e$ and the space delay error $d_e$ are determined during an alignment calibration process.

5. The printer of claim 4, wherein the alignment calibration process comprises:

printing a first pattern on a first side of media and a second pattern on the second side of the media at a first print speed;

measuring a first offset between the first and the second patterns;

printing a first pattern on a first side of media and a second pattern on the second side of the media at a second print speed, different from the first print speed;

measuring a second offset between the first and the second patterns;

determining delay error $T_e$ and the space delay error de using the first and the second offsets;

storing the time delay error $T_e$ and the space delay error $d_e$.

6. A method of printing, comprising:

printing an image on a first side of media, including an alignment mark, where the media is moving in a media path;

detecting the alignment mark on the media with a sensor;

when the alignment mark is detected, determining a velocity of the media moving in the media path;

calculating an alignment offset based on the velocity of the media, printing an image on a second side of the media where a position of the second image is determined using the alignment offset.

7. The method of printing of claim 6, wherein the velocity of the media is on-the-ramp.

8. The method of printing of claim 7, wherein the velocity of the media is decelerating.

9. The method of claim 1, wherein the alignment offset is calculated using a time delay error $T_e$ and a space delay error $d_e$.

10. The method of printing of claim 9, wherein the time delay error $T_e$ and the space delay error $d_e$ are determined during an alignment calibration process and the alignment calibration process comprises:

printing a first pattern on a first side of media and a second pattern on the second side of the media at a first print speed;

measuring a first offset between the first and second patterns;

printing a first pattern on a first side of media and a second pattern on the second side of the media at a second print speed, different from the first print speed;

measuring a second offset between the first and second patterns;

determining time delay error $T_e$ and the space delay error de using the first and the second offsets;

storing the time delay error $T_e$ and the space delay error $d_e$.

11. The method of claim 1, wherein the alignment offset is only recalculated when the media velocity has changed by more than a threshold velocity.

12. A method of calibrating a printer, comprising:

printing a first pattern on a first side of media and a second pattern on the second side of the media at a first print speed;

measuring a first offset between the first and the second patterns;

printing a first pattern on a first side of media and a second pattern on the second side of the media at a second print speed, different from the first print speed;

measuring a second offset between the first and the second patterns;

based on the first and second offsets, adjusting a location of an image on the second side of media with respect to an image on the first side of the media.

13. The method of calibrating the printer of claim 12, wherein the first print speed is a fast print speed relative to the second print speed.

14. The method of calibrating the printer of claim 12, wherein the first print speed is a maximum print speed and the second print speed is a minimum print speed.

15. The method of calibrating the printer of claim 12, wherein the media does not stop between when the images are printed at the first speed and when the images are printed at the second speed.

16. the method of calibrating the printer of claim 12, further comprising determining a time delay error $T_e$ and a space delay error $d_e$ between a sensor and a duplex printhead using the first and the second offsets.

17. The method of calibrating the printer of claim 12, wherein adjusting the location of the image on the second side of media with respect to the image on the first side of the media is accomplished using a time delay error $T_e$ and a space delay error $d_e$.

* * * * *